US005820490A

United States Patent [19]

Hronas et al.

[11] Patent Number: 5,820,490

[45] Date of Patent: Oct. 13, 1998

[54] COUPLED GOLF TEES

[76] Inventors: John J. Hronas, 4608 Upland Dr.; Michael J. Hronas, 848 W. 52nd St.; Joseph Mihna, 2005 Andover La., all of Erie, Pa. 16509

[21] Appl. No.: 929,689

[22] Filed: Sep. 15, 1997

[51] Int. Cl.[6] ..... A63B 57/00

[52] U.S. Cl. ..... 473/391; 473/386

[58] Field of Search ..... 473/386–403, 473/139, 142, 147

[56] References Cited

U.S. PATENT DOCUMENTS

| | | | |
|---|---|---|---|
| D. 279,121 | 6/1985 | Wampler | D21/208 |
| 1,631,270 | 6/1927 | Jones | 473/391 |
| 1,655,751 | 1/1928 | Cody | 473/391 |
| 1,730,046 | 10/1929 | Stow | 473/391 |
| 1,736,583 | 11/1929 | Deike | 473/393 |
| 2,668,710 | 2/1954 | Carlson | 473/393 |
| 3,194,557 | 7/1965 | Holley | 473/147 |
| 3,220,727 | 11/1965 | Legan | 473/389 |
| 4,893,818 | 1/1990 | Liccardello . | |
| 4,998,732 | 3/1991 | Gallant . | |
| 5,211,395 | 5/1993 | Liao | 473/391 |
| 5,221,090 | 6/1993 | Hong | 473/390 |
| 5,242,170 | 9/1993 | Ward . | |

*Primary Examiner*—Steven Wong
*Attorney, Agent, or Firm*—William L. Krayer

[57] ABSTRACT

Two golf tees are tethered together by a cord, preferably a monofilament which passes through the stems of the tees. Pegs mounted on a home station are inserted into the tees for storage and carrying the tees through the game. In use, both tees are inserted into the ground, and the tether prevents loss of the tees. The tees are made of high density polyethylene or other similar tough material, as the assembly is designed to prevent loss and breakage of tees.

12 Claims, 6 Drawing Sheets

COUPLED GOLF TEES

TECHNICAL FIELD

This invention relates to golf tees and particularly to a novel pair of tees held loosely together by a relatively long cord. The tees are preferably temporarily moored to a home station having pegs inserted into sockets in the ball-supporting ends of the tees. The home station may be shaped and used like a handle for aid in inserting the tees into the ground.

BACKGROUND OF THE INVENTION

Even occasional golfers are familiar with the sight of broken and lost tees littering the grounds, particularly around the driving areas. Golfers often carry an excess of tees to be sure of having good ones throughout the course; this means frequently purchasing packets of tees and keeping track of them throughout the game. Sometimes the tees are broken not on being struck by a club, but in the process of pushing into hard ground. Inevitably, many golfers do not remove the remains of such broken tees.

Those who maintain golf courses must provide the attention and labor necessary to remove the broken and lost tees, and it is not uncommon for the well-used and precisely set lawnmowers on golf courses to be damaged by stray golf tees. The common "expendable" wooden tee is a nuisance and an expense for golf course caretakers and users alike.

Wampler, in U.S. Design Pat. No. 279,121 illustrates a sturdily constructed tee which is tethered to a permanent base, suggesting use in driving ranges. Wampler does not address the needs of the golfer playing an entire golf course, nor the caretakers of such a course who cannot construct permanent tees such as may be used on a driving range. The art is in need of a tee which is portable, resistant to destruction, and always readily found after use.

SUMMARY OF THE INVENTION

Our invention provides golf tees which are virtually unbreakable and unlosable. At the same time, they are in a convenient form which can be easily carried and inserted into the ground.

Two tees, made of a hard and/or dense synthetic resin, are tethered together by a strong thin cord. The golfer inserts one of the tees in the ground for use in driving or otherwise striking the ball, and the other is anchored in the ground nearby. When the tee supporting the ball is struck and removed by the golf club, it is held by the tether to the anchored tee and accordingly is not lost. Being made of a strong synthetic plastic, the tee does not break and may be used many times. Of course, either tee may be used for either purpose, supporting the ball or anchoring. The two tees may be of different lengths so the longer may conveniently be used for woods and the shorter one for irons.

Our invention includes a handle or home station for the tee couple, which includes two pegs or protrusions designed to be inserted into complementary sockets or holes, preferably with a snug fit, in the tops of the tees. The assembly, comprising the home station, the two tees, and the tether, which may be wound around the home station, is easily placed in a shirt pocket or golf bag pocket for ready retrieval at the next point of use. The home station is preferably shaped to act as a handle to assist in the insertion of a tee into the ground. Accessories may be built into or on the home station; such accessories include an awl, for aid in making a hole in hard ground for the tee, an attachment or slot for carrying ball markers, and/or a ball repair fork.

DETAILED DESCRIPTION OF THE INVENTION

Figure 1:
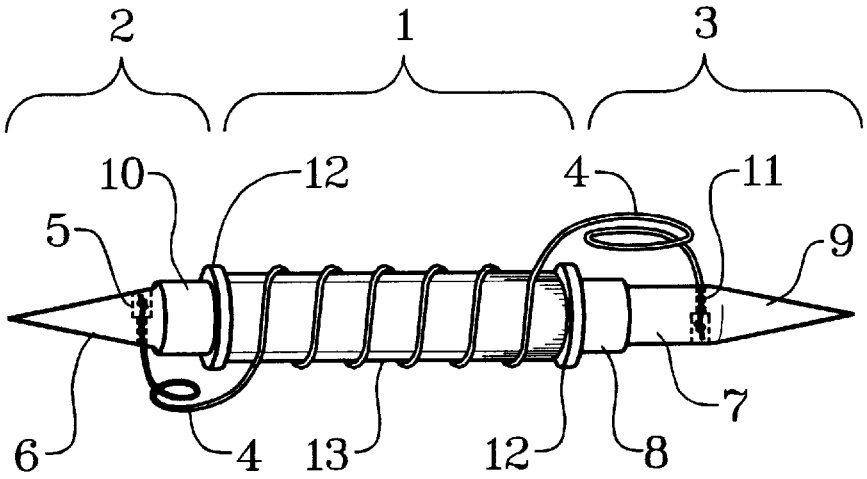
FIG. 1 is a side view of the coupled tees moored to the home station.

In FIG. 1, the home station 1 is seen to have temporarily fixed to it tees 2 and 3 tethered together by line 4 which is inserted and tied through a bore 5 in probe 6 of tee 2 and bore 11 in tee stem 7 of tee 3. In this version of the invention, tee 3 is longer than tee 2, having a stem 7 between cylindrical shoulder 8 and probe 9, while probe 6 of the shorter tee 2 attaches integrally directly to upper section 10. Home station 1 has two end flanges 12 and a central body portion 13, which may be cylindrical as shown in FIG. 1 or flat as seen in FIG. 5. Tees 2 and 3 are attached to home station 1 by pegs 17 inserted into them, as will be seen in FIGS. 2, 3, and 4. Line 4 is preferably a monofilament such as a nylon fishing line.

The invention is described and illustrated showing the longer tee 3 being used as the working tee—that is, the tee which will support the ball. This will normally be the case when the user intends to use a driver or other wood club, or a low numbered iron, to strike the ball, while the shorter tee 2 will normally be used when a higher numbered iron is to be used to strike the ball held at a lower height; however, either tee may be used for either purpose within the concept of our invention.

Figure 2A:
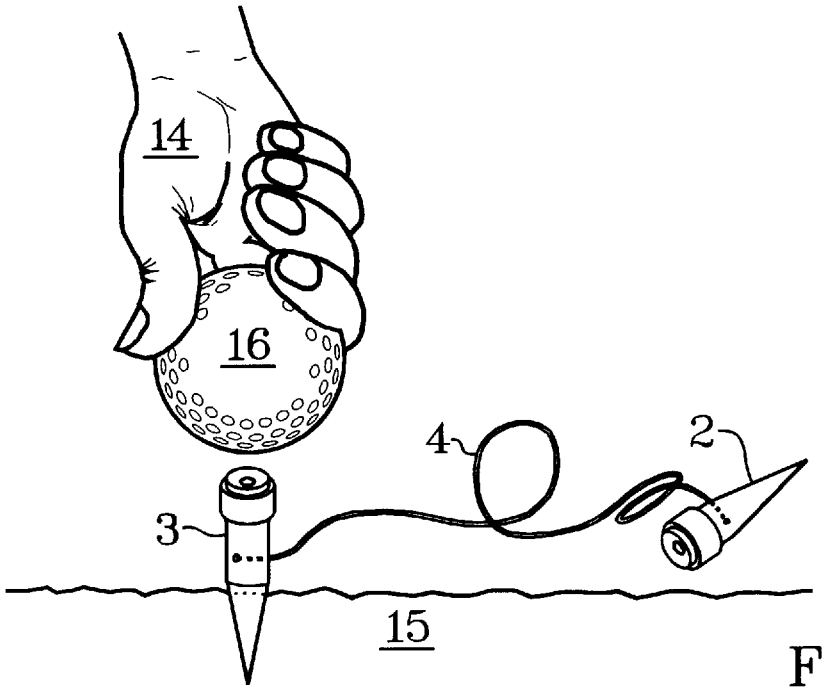
FIGS. 2*a* and 2*b* illustrate the insertion of the coupled tees into the ground in preparation for use.
Figure 2B:
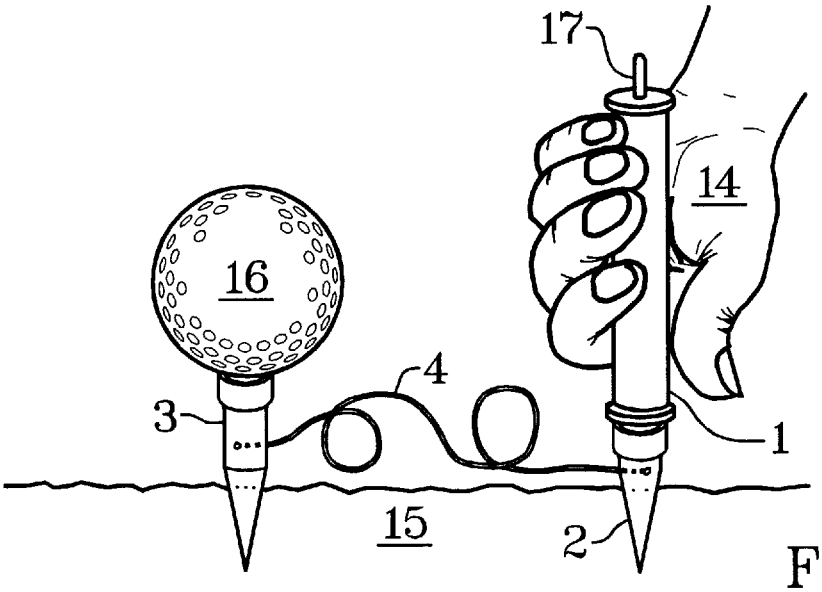

In FIG. 2*a*, tee 3 is seen to have been removed from the home station 1 (see FIG. 1) and the user 14 is pushing it into the ground 15 while holding ball 16. Tee 3 is still connected by line 4 to tee 2, which is lying on ground 15. FIG. 2*b* shows that tee 3 was removed from peg 17 on home station 1; home station 1 may be used as an aid to pushing the shorter tee 2 into the ground 15 while line 4 remains in place to prevent tee 3 from being knocked or otherwise moved farther from the area than the length of line 4 will permit. Home station 1 may be left in place on tee 2 while the ball 16 is struck from tee 3. The tees 2 and 3 are made preferably of high density polyethylene (HDPE) and may be either injection molded or machined from extruded HDPE rod. Other synthetic resins of similar hardness, toughness or resiliency may be used. Tee 2 may be replaced by a tee similar to tee 3—that is, with a longer tee if desired. Home station 1 may also be used as an aid to insertion of tee 3 into the ground 15, in the same manner as illustrated for tee 2.

Figure 3:
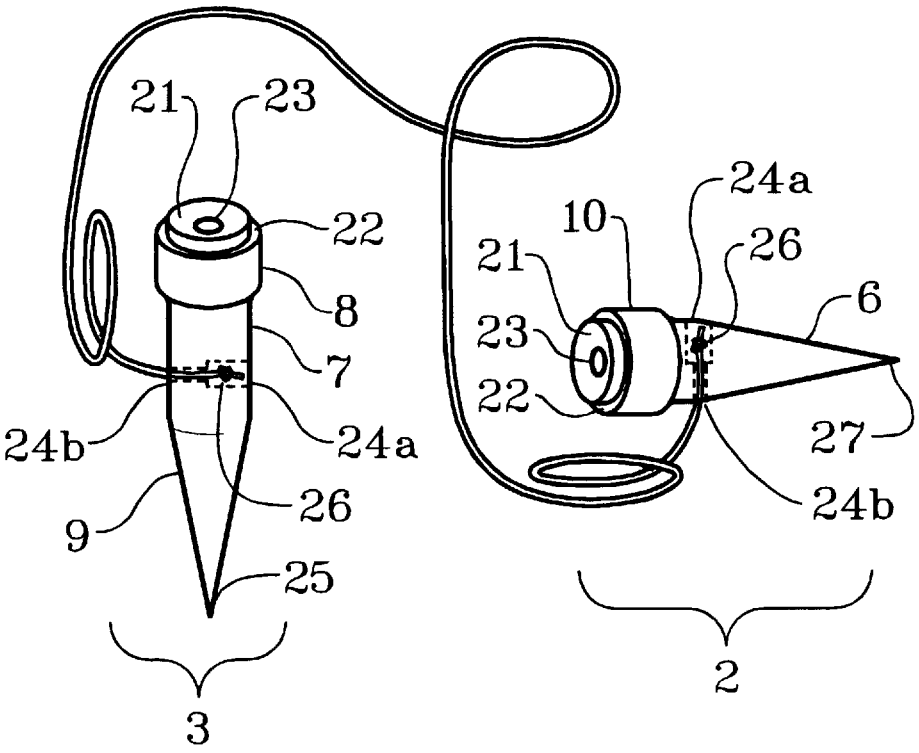
FIG. 3 illustrates the detail of the tether connections and the socket in the tees for insertion of the complementary peg on the home station.

The details of the preferred form of tee are shown in FIG. 3. Tees 2 and 3 each have a central socket 23 designed to receive complementarily shaped pegs 17 on home station 1 (see FIG. 2*b*). In the preferred form of our tee, the top surfaces 21 of tees 2 and 3 are slightly concave and are of a diameter slightly less than shoulder 8 of tee 3 or upper section 10 of tee 2, defining a shelf 22 around the perimeter of the tee. A bore (bores 5 and 11 in FIG. 1) on each tee comprises a large diameter portion 24*a* and a small diameter portion 24*b*. Line 4 is held in place by a knot 26 which will pass through large diameter portion 24*a* but not small diameter portion 24*b*. Below stem 7 of tee 3 is a conical point 25; the overall angle of the point 25 is preferably about 25°, but may vary from about 12 degrees to about 30 degrees. Tee 2 may have a similar conical point 27.

Figure 6:
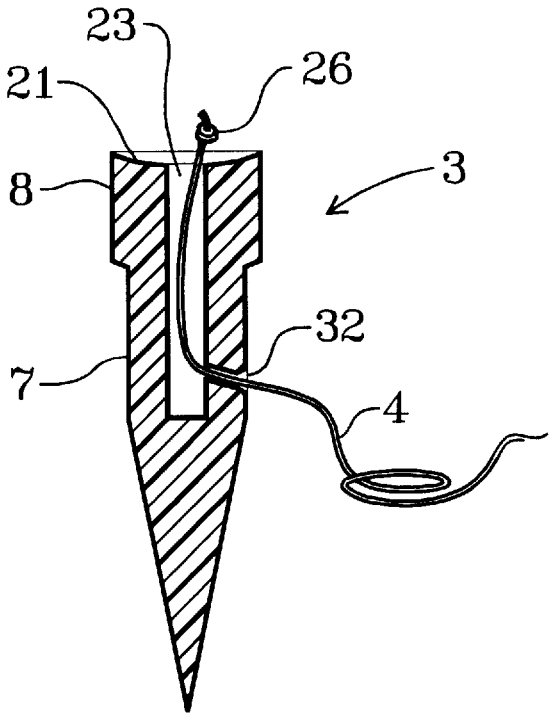
FIG. 6 is a section of a preferred version of our tee showing the connection of the line through the side.

Shelf 22 is not necessary; top surface 21 may be the top surface of shoulder 8 and/or upper section 10—see FIG. 6. Line 4 should be at least about six inches long but need not be more than about six feet. We prefer to use a line 4 of from one to five feet long. As our invention includes the combination of the two tees tethered together, whether or not a home station is used, it may be appreciated that other types of storage and carrying devices may be used, such as a rack having sockets for the pointed ends of the tees; in this case the sockets in the tees may be dispensed with and the rack may have a rounded protrusion for contacting the top of the tee to push it into the ground.

Figure 4:
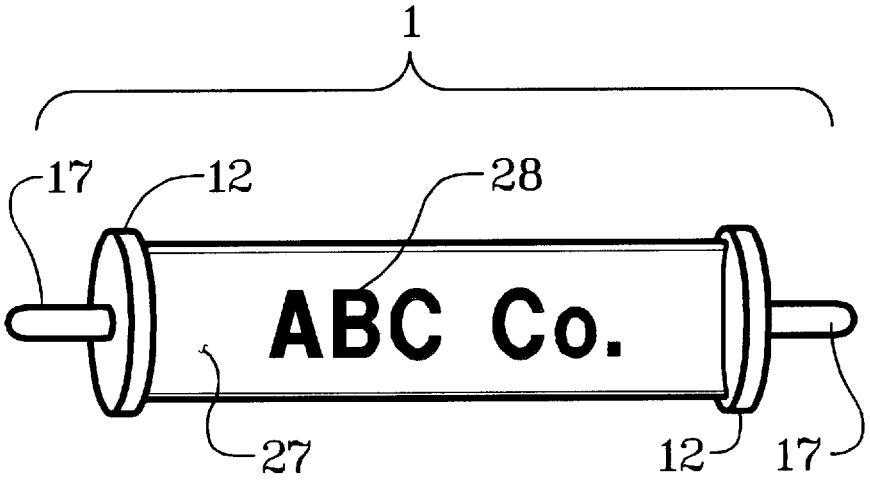
FIG. 4 is a view of the home station without the tees or line.
Figure 5:
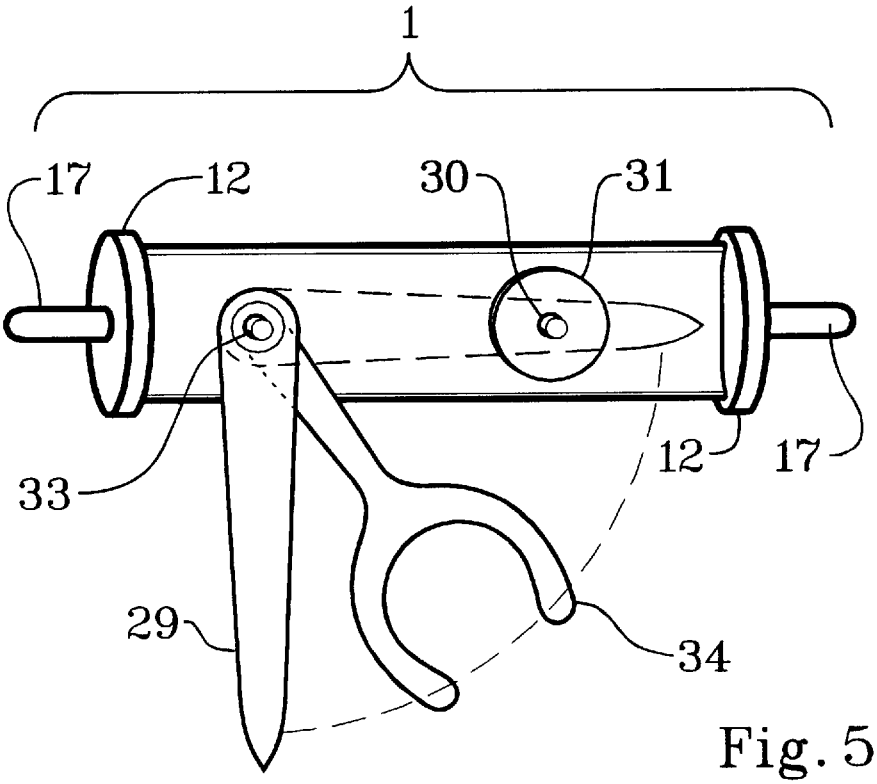
FIG. 5 illustrates three optional features—an awl, a rack for ball spotters, and a ball repair fork.

FIG. 4 illustrates a version of the home station 1 in which the body portion 27 is flat and may contain a logo or advertising message 28. Flanges 12 and pegs 17 are similar to those of FIGS. 1 and 2. Persons skilled in the art will realize that body portion 27 and flanges 12 may be merged in a monolithic body portion which may be cylindrical or otherwise variously shaped.

FIG. 5 shows our invention with three optional accessories—an awl 29, a ball spotter rack 30 holding ball spotters 31, and a ball mark repair fork 34. Ball spotters 31 are detachable and may be held in place by awl 29 when it is in the storage position shown by the dotted lines; awl 29 and ball mark repair fork 34 may pivot on pivot 33, awl 29 may be used in piloting a hole in hard ground for a tee, and ball mark repair fork 34 is used for repairing marks on balls.

In FIG. 6, the preferred variation of the tee 3 is shown in section, revealing the socket 23 and a single bore 32 for the monofilament line 4 having knot 26 which prevents the line 4 from passing through the bore 32. A similar single bore may be used in the shorter tee 2. Preferably the bore 32 will be placed at a level in socket 23 below the farthest point which can be reached by a peg 17, although this is not considered essential.

Thus it is seen that our invention comprises two tees tethered together by a line or cord, and further comprises two tees tethered together by a line or cord, the tees having means for mooring to a home station designed as a handle to aid in inserting the tees into the ground. The invention is otherwise described in the claims below.

We claim:

1. A golfing device comprising (a) two golf tees, each of said golf tees having a top surface and a pointed end, each golf tee also having a socket in the center of its top surface, (b) a cord connecting said golf tees, and (c) a home station, said home station comprising a body portion and two pegs, each of said pegs being of a shape and size to fit in a socket of one of said tees.

2. A golfing device of claim 1 wherein said cord connects said golf tees from a transverse bore in each of said golf tees.

3. A golfing device of claim 2 wherein said transverse bore includes a portion of relatively large internal diameter and a portion of relatively small internal diameter.

4. A golfing device of claim 2 wherein said transverse bore is from an outside surface to said socket.

5. A golfing device of claim 1 wherein said home station includes two end flanges.

6. A golfing device of claim 1 wherein said pointed end is conical and has a point angle of about 12 to about 30 degrees.

7. A golfing device of claim 1 wherein said home station includes a rack of ball spotters detachably mounted thereon.

8. A golfing device of claim 1 wherein said body portion of said home station is substantially cylindrical.

9. A golfing device of claim 1 wherein said top surfaces of said golf tees are slightly concave.

10. A golfing device of claim 1 wherein said body portion of said home station is substantially flat.

11. A golfing device of claim 1 wherein said home station includes at least one of an awl and a ball repair fork mounted thereon.

12. A golfing device comprising (a) two golf tees, (b) a cord connecting said golf tees, and (c) means for storing and carrying said golf tees and cord, said means for storing and carrying including means complementarily fitting said tees.

* * * * *